US007361315B2

(12) United States Patent
Nakajima et al.

(10) Patent No.: US 7,361,315 B2
(45) Date of Patent: Apr. 22, 2008

(54) MICRO-REACTOR FOR BIOLOGICAL SUBSTANCE INSPECTION AND BIOLOGICAL SUBSTANCE INSPECTION DEVICE

(75) Inventors: Akihisa Nakajima, Sagamihara (JP); Eiichi Ueda, Akishima (JP); Kusunoki Higashino, Osaka (JP); Yasuhiro Sando, Amagasaki (JP); Nobuhisa Ishida, Kyoto (JP)

(73) Assignee: Konica Minolta Medical & Graphic, Inc. (JP)

( * ) Notice: Subject to any disclaimer, the term of this patent is extended or adjusted under 35 U.S.C. 154(b) by 0 days.

(21) Appl. No.: 11/254,210

(22) Filed: Oct. 19, 2005

(65) Prior Publication Data

US 2006/0088451 A1 Apr. 27, 2006

(30) Foreign Application Priority Data

Oct. 26, 2004 (JP) ..... 2004-310744

(51) Int. Cl.
*B01L 3/00* (2006.01)

(52) U.S. Cl. ..... 422/102; 422/58; 422/61; 422/68.1; 422/100; 436/174; 436/180

(58) Field of Classification Search ..... 422/58, 422/61, 68.1, 82.05, 99, 100, 102; 436/174, 436/180

See application file for complete search history.

(56) References Cited

U.S. PATENT DOCUMENTS 6,063,589 A * 5/2000 Kellogg et al. ..... 435/24
6,143,248 A * 11/2000 Kellogg et al. ..... 422/72
6,296,020 B1 * 10/2001 McNeely et al. ..... 137/806
6,302,134 B1 * 10/2001 Kellogg et al. ..... 137/74
6,319,469 B1 * 11/2001 Mian et al. ..... 422/64
6,591,852 B1 * 7/2003 McNeely et al. ..... 137/14
6,637,463 B1 * 10/2003 Lei et al. ..... 137/803
6,713,298 B2 * 3/2004 McDevitt et al. ..... 435/287.6
6,921,253 B2 * 7/2005 Shuler et al. ..... 417/559
7,032,608 B2 * 4/2006 Koeneman et al. ..... 137/15.18
2004/0109793 A1 * 6/2004 McNeely et al. ..... 422/100
2004/0115838 A1 6/2004 Quake et al.
2004/0200724 A1 10/2004 Fujii et al.
2004/0224380 A1 * 11/2004 Chou et al. ..... 435/29
2005/0092662 A1 * 5/2005 Gilbert et al. ..... 210/97

FOREIGN PATENT DOCUMENTS

WO WO 01/88525 A1 11/2001
WO WO 01/90614 A2 11/2001

* cited by examiner

*Primary Examiner*—Jill Warden
*Assistant Examiner*—Dwayne K Handy
(74) *Attorney, Agent, or Firm*—Cantor Colburn LLP

(57) ABSTRACT

The object of the present invention is to provide a micro-reactor, equipped with a high-precision liquid feed system of simple structure, capable of high-precision analysis of at least one item. The present invention provides a micro-reactor for biological substance inspection including a sample storage section, a reagent storage section, a sample pre-processing section, a micro-pump connecting section and a branched minute flow path. And a sample pre-processed by the sample pre-processing section is fed into the minute flow path branched off into at least two parts by a micro-pump and a liquid dividing section, and on the downstream side of each of the branched minute flow paths, the sample is fed to a flow path constituting a reaction site, and then to a flow path constituting the detection site, thereby providing simultaneous measurement of a plurality of items of a sample.

15 Claims, 7 Drawing Sheets

MICRO-REACTOR FOR BIOLOGICAL SUBSTANCE INSPECTION AND BIOLOGICAL SUBSTANCE INSPECTION DEVICE

This application is based on Japanese Patent Application No. 2004-310744 filed on Oct. 26, 2004, in Japanese Patent Office, the entire content of which is hereby incorporated by reference.

BACKGROUND OF THE INVENTION

1. Field of the Invention

The present invention relates to a micro-reactor for biological substance inspection and a biological substance inspection device including the micro-reactor.

2. Description of the Related Art

By free use of micro machine technology and micromachining technology, development efforts have been made in recent years to create a system wherein the conventional apparatus and measures for preparation of a sample, chemical analysis and chemical synthesis' (e.g. a pump, valve, flow path and sensor) are formed into minute structures, and are integrated on one chip. This is also called the μ-TAS (Micro total Analysis System), bioreactor or lab-on-chip or biochip. Its application is anticipated in the field of medical examination, diagnosis, environmental measurement and agricultural production. As can been seen especially in the field of genetic screening, when a complicated process, advanced manual skill and machine operation technique are involved, an automated, high-speed, simplified micronized analysis system brings about immeasurable advantages of permitting analysis independently of time and place, in addition to various advantages in terms of costs, required quantity of samples and required time.

In the field of various inspections including the clinical examination, primary importance is attached to quantitative analysis, precision of analysis and economy in the chip for analysis capable of producing speedy results independently of place. Since the chip for analysis is subjected to severe restrictions for the size and configuration, it is important to establish a highly reliable liquid feed system of simple structure. Thus, there has been an active demand for a reliable, high-precision micro fluid control device. The present inventors have already proposed a micro pump system capable of meeting such requirements (Official Gazette of Japanese Patent Tokkai 2001-322099 and Official Gazette of Japanese Patent Tokkai 2004-108285).

One of the most important required tasks of the micro-reactor is to provide a method for analysis capable of minimizing the amount of the required sample and reagent. To achieve this purpose, the liquids (samples or reagents) must be mixed efficiently in a mixing flow path or a reaction chamber. Further, a mechanism capable of simple and highly sensitive detection and determination of a trace quantity of reaction products must also be mounted on the chip. In the detection of a gene, it is a common practice to use the amplification reaction by the PCR (Polymerase Chain Reaction) method, and its usefulness is extensively recognized. However, since the PCR allows a trace quantity of genes present in the sample to be amplified hundreds of thousands through several millions times, it will have a serious impact of cross contamination carry-over and contamination. Frequent reading errors during amplification of the DNA are often pointed out. In the immunoassay, it is necessary to eliminate the possibility of nonspecific interaction. If such latent disadvantages in analysis are neglected, a wrong conclusion may be reached due to incorrect results. In the micro-reactor, it is necessary to configure an analysis system where adequate steps are taken to address such problems.

A large volume of samples, particularly the chips using clinical samples subjected to possible contamination and infection, should preferably be disposable. It is necessary to solve problems involved in a great variety of uses and production costs.

The micro-reactor providing a simple and quick inspection measure raises specific problems to be solved in practical use, and these problems have been expected to be solved.

[Patent Document 1] Official Gazette of Japanese Patent Tokkai 2001-322099

[Patent Document 2] Official Gazette of Japanese Patent Tokkai 2004-108285

[Non-Patent Document 1] KIMIZUKA Fusao and KATO Kuninoshin: "DNA Chio Technology and its Application", "Protein, Nucleic acid and Enzyme" Vol. 43, No. 13, (1998), Kyoritsu Publishing Co., Ltd.

SUMMARY OF THE INVENTION

A micro-reactor for biological substance inspection and a DNA inspection device including the same according to an embodiment of the present invention has been developed to solve the aforementioned problems involved in the conventional art. An embodiment of the present invention is may provide a micro-reactor, equipped with a high-precision liquid feed system of simple structure, capable of high-precision analysis of at least one item.

Another feature of the present invention may provide a biological substance inspection device equipped with a disposable micro-reactor and a means for controlling the function of the micro-reactor, detecting and processing.

The present invention may provide a micro-reactor for biological substance inspection including:

a sample storage section;

a reagent storage section;

a sample pre-processing section;

a micro-pump connecting section; and a branched minute flow path;

wherein a sample pre-processed by the sample pre-processing section is fed into the minute flow path branched off into at least two parts by a micro-pump and a liquid dividing section; and wherein, on the downstream side of each of the branched minute flow paths, the sample is fed to a flow path constituting a reaction site, and then to a flow path constituting the detection site, thereby providing simultaneous measurement of a plurality of items of a sample.

An embodiment of the present invention may provide a micro-reactor for biological substance inspection including:

a sample storage section;

a reagent storage section;

a control storage section;

a micro-pump connecting section; and a branched minute flow path;

wherein a reagent filled therein or a liquid mixture thereof is fed into the minute flow path branched off into at least two parts by a micro-pump and a liquid dividing section; and wherein, on the downstream side of each of the branched minute flow paths, the sample is fed to a flow path constituting a reaction site, and then to a flow path constituting the detection site, thereby providing simultaneous measurement of the sample and control.

The aforementioned micro-pump is a piezo-pump comprising:

a first flow path whose resistance preferably changes in response to pressure difference;

a second flow path wherein the percentage of the change in the resistance of this flow path with respect to the change in the pressure differenc is smaller than that in the first flow path;

a pressure chamber connected to the aforementioned first and second flow paths; and a actuator for changing the pressure inside the pressure chamber.

The aforementioned liquid dividing section contains:

a branched minute flow path;

a liquid feed control member capable of controlling the passage of liquid by the micro-pump pressure, wherein the passage of the liquid is blocked until the liquid feed pressure in the forward direction reaches a predetermined level, and the liquid feed pressure above the preset level is then added to allow passage of the liquid; and a backflow preventing member for preventing the liquid in the flow path from back-flowing.

In the aforementioned biological substance inspection micro-reactor, the minute flow path is provided with a liquid feed control member and backflow preventing member. The feed of the liquid in the branched flow path, determination of the amount of fed liquid and mixing of liquids are controlled by the micro-pump, liquid feed control member and backflow preventing member.

At least the flow path of the detection site is preferably made of polystyrene. The biotinophilic protein adsorbed on the detection site is preferably combined with the biotin labeled to a probe substance or the biotin labeled to the 5'-terminal of a primer used for gene amplification reaction.

The aforementioned biotinophilic protein is preferably streptavidin.

An embodiment of the present invention may provide a biological substance inspection device containing:

the aforementioned micro-reactor for biological substance inspection; and a detecting device for ensuring that the biological substance combined with a biotin containing probe at the reaction site of the minute flow path thereof is combined with the biotinophilic protein adsorbed on the detection site of the minute flow path thereof, and colors are developed from this probe, thereby allowing optical detection thereof to be achieved.

The aforementioned biological substance inspection device is composed of:

a apparatus proper further composed of the aforementioned detecting device, micro-pump and temperature control apparatus being integrated into one piece; and a micro-reactor that can be mounted on this apparatus proper.

When the micro-reactor is mounted on the apparatus proper, the aforementioned combination of the biological substance, the development of colors from the probe, and the detection thereof are automatically performed.

The biological substance inspection device is based on a system configuration wherein a chip component, for each sample, carrying reagents and liquid feed elements, is arranged separately from a control/detection component as an inspection device proper. Since the flow path system containing the pump and valve is designed in a simple structure, it provides a high precision in liquid feed, because of greater resistance to entry of bubbles and smaller dead volume. Thus, such serious problems as cross contamination, carry-over and contamination hardly arise in microanalysis and amplification reaction. To eliminate the adverse effect of reaction failure, contamination or rise of the background, the micro-reactor incorporates a flow path configuration that permits simultaneous analysis of positive control and negative control.

The micro-reactor including the materials and constituent elements is oriented toward mass production. Moreover, the probe and reagent used for detection are readily available, and therefore, can be manufactured at a lower cost. The biological substance inspection device and micro-reactor may provide simultaneous measurement of a plurality of items, and are versatile to meet multipurpose requirements.

The following describes the micro-reactor and the biological substance inspection device composed of this micro-reactor, a micro-pump, various control apparatuses and a detection apparatus. In the present Specification, "gene" refers to the DNA or RNA for carrying genetic information for finding some functions. It may also refer to the DNA or RNA as a mere chemical substance, depending on cases. "Element" refers to the functional parts installed on the micro-reactor. "Minute flow path" denotes the flow path formed on the micro-reactor.

Outline of the Micro-reactor and Biological Substance Inspection Device

The micro-reactor is equipped with a sample storage section, a reagent storage section, and a sample pre-processing section, a micro-pump connecting section and a branched minute flow path. The sample processed by the aforementioned sample pre-processing section is fed into the minute flow path branched off into at least two parts by a micro-pump and a liquid dividing section. On the downstream side of each of the branched minute flow paths, the sample is fed to a flow path constituting a reaction site, and then to a flow path constituting the detection site, thereby providing simultaneous measurement of a plurality of items in sample analysis.

Further, the micro-reactor is equipped with a sample storage section, a reagent storage section, a control storage section, a micro-pump connecting section, and a branched minute flow path. A reagent filled therein or a liquid mixture thereof is fed into the minute flow path branched off into at least two parts by a micro-pump and a liquid dividing section. On the downstream side of each of the branched minute flow paths, the sample is fed to a flow path constituting a reaction site, and then to a flow path constituting the detection site, thereby providing simultaneous measurement of the sample and control.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 2-1 is a schematic diagram representing a micro-reactor for biological substance inspection, wherein the micro-pump 11 is a device separate from this micro-reactor;

FIG. 2-2 is a diagram showing the structure of the portion, communicating with the flow path of FIG. 2-1, for reaction and detection of the sample and reagent, wherein liquid feed control member 13 is not illustrated, and the micro-pump 11 is separate from the micro-reactor;

DETAILED DESCRIPTION OF THE PREFERRED EMBODIMENT

Figure 1:
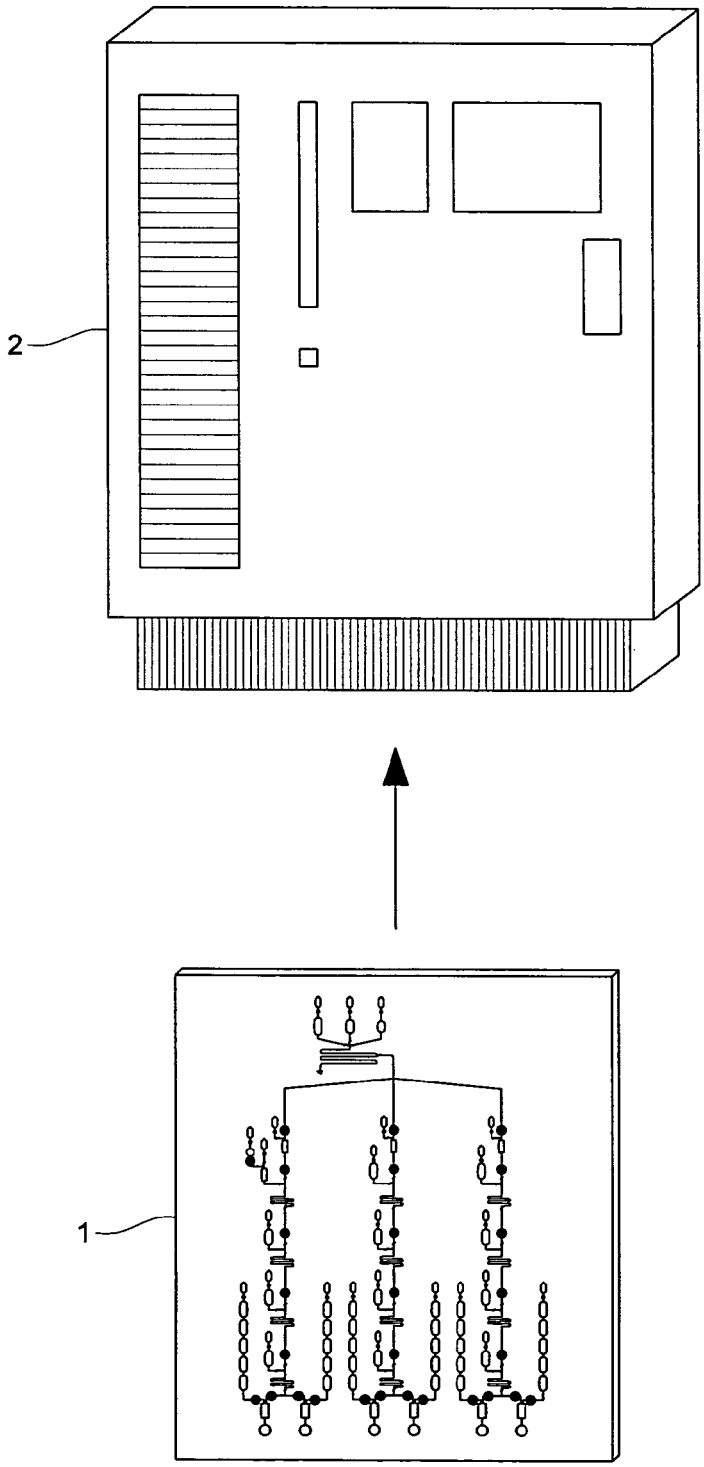
FIG. 1 is a schematic diagram representing a biological substance inspection device composed of a micro-reactor and an apparatus proper.
Figures 1, 2:
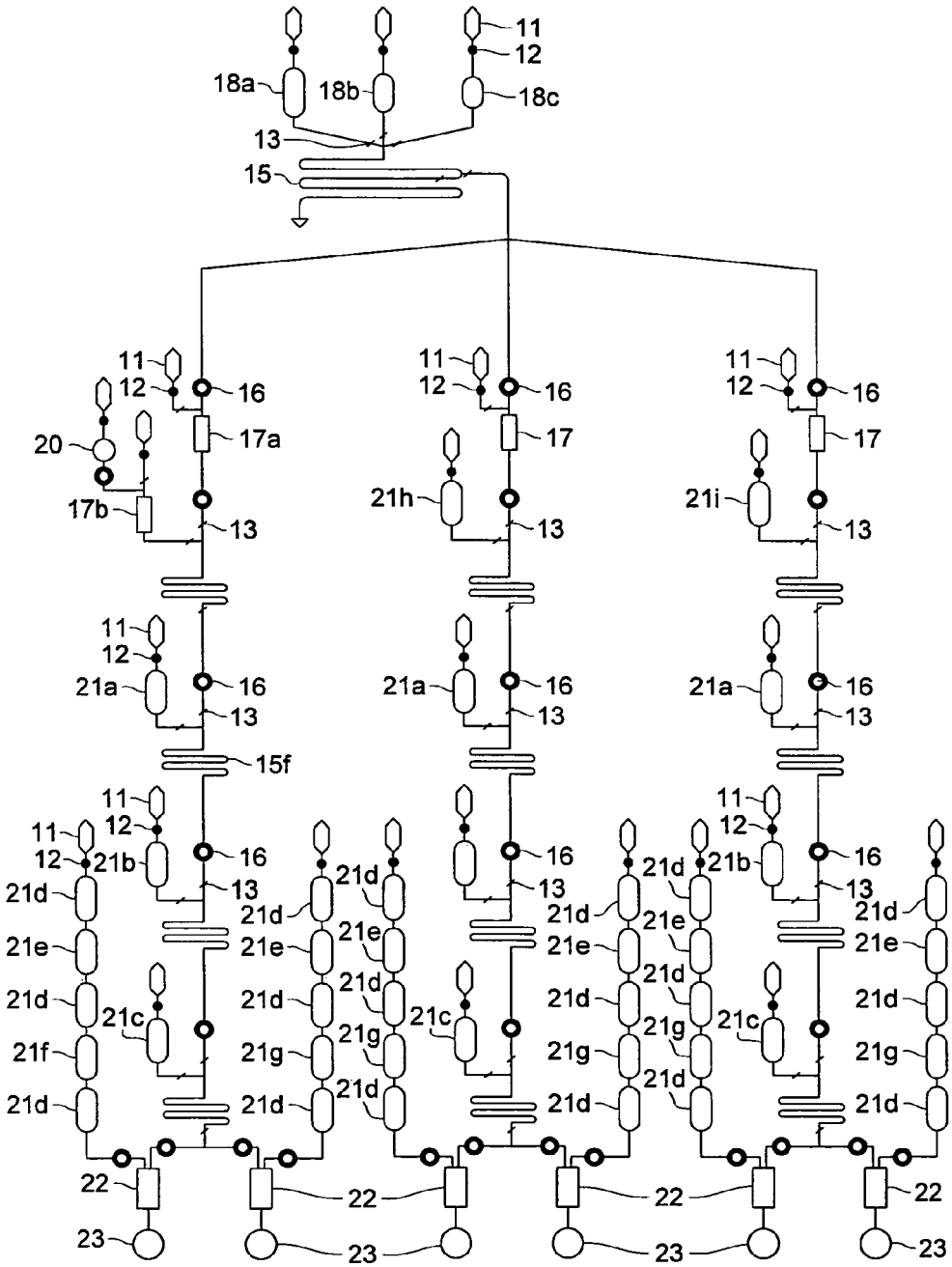
Figure 2:
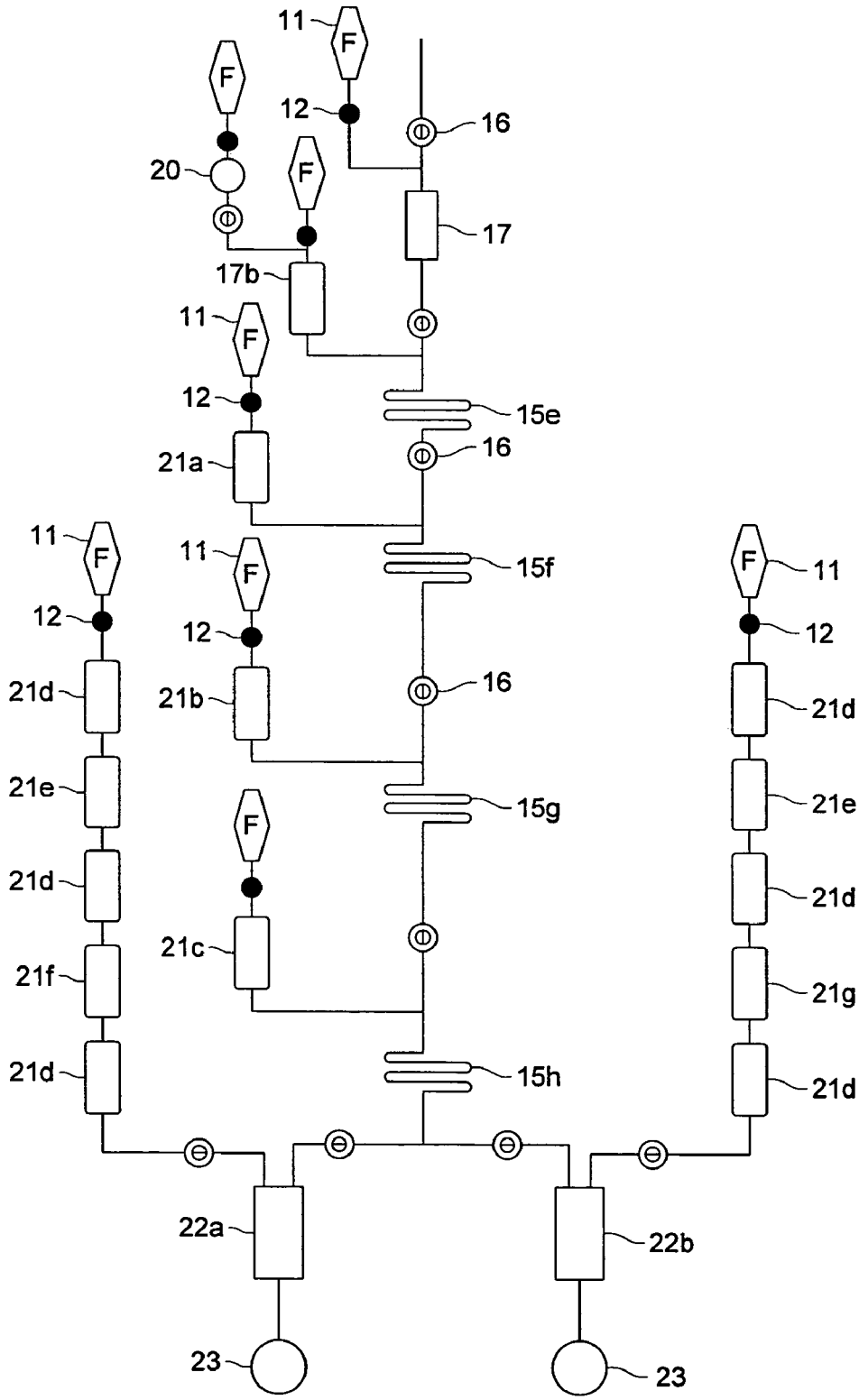

FIG. 1 is a schematic diagram representing a biological substance inspection device (also called the biological substance inspection apparatus) composed of a micro-reactor for biological substance inspection and an apparatus proper. FIG. 2 is a schematic diagram representing the aforementioned micro-reactor as an embodiment of the present invention.

The micro-reactor 1 shown in FIGS. 1 and 2 is made up of a chip composed of an adequate combination of the members made of a plastic resin, glass, silicon and ceramic. The minute flow path and the frame of the micro-reactor are preferably made of plastics characterized by easy, economical processing and molding, and easy incineration and scrapping. Of these plastics, the polystyrene resin is excellent in moldability and is very likely to adsorb streptavidin, as will be described later. The detection site can be easily formed on the minute flow path. In this respect, use of polyethylene is preferred. Further, for optical detection of a fluorescent substance or a color reaction product in the micro-reactor, at least the detecting site, covering the detection site of the minute flow path, on of the surface of the micro-reactor must be transparent or must be made of transparent plastics.

FIG. 2 shows an example of the typical flow path structure of the micro-reactor of the present invention. In the layout of the flow path and liquid feed element, the reagent flows to basically three analysis flow paths (diverging into three flow paths, wherein the minute flow path of such a basic structure is also called "analysis flow path" in the following description) from the reagent storage section 18 and the flow path 15 toward reagent separation. The analysis flow path on the left is intended to analyze the sample. In FIG. 2, this corresponds to the analysis of one item. The analysis flow path at the center is intended for positive control, while the analysis flow path on the right is intended for negative control. In FIG. 2, one flow path is shown to analyze the sample. To analyze a plurality of items, at least two flow paths must be formed for analysis. The number of the flow paths is restricted by the number and layout of the elements to be provided, as well as the number of the items.

The biological substance inspection device is composed of an apparatus proper 2 further composed of a micro-pump, a control apparatus for controlling the micro-pump, a micro-pump and temperature control and a detecting device being integrated into one piece; and a micro-reactor 1 that can be mounted on this apparatus proper 2. A sample is put into the micro-reactor 1 filled with reagent in advance, and the micro-reactor is mounted on the apparatus proper 2. Then the mechanical connection for operating the liquid feed pump and electrical connection for control (if required) are provided, and connection of the biological substance with a probe, color development from the probe and detection thereof are provided automatically.

The micro-reactor and biological substance inspection device are preferably used for inspection of a gene and nucleic acid, in particular. In this case, a mechanism for PCR amplification is mounted on the micro-reactor. In the following description of the Specification, the micro-reactor and biological substance inspection device used mainly for the inspection of the gene will be mainly discussed. It can be said, however, that almost the same basic structure is used for the micro-reactor to analyze a biological substance such as protein and enzyme, except for the gene. Normally, it is sufficient that the sample pre-processing section 20*a*, reagents and probes are modified. In this case, the layout and number of the liquid feed elements will be modified. Those skilled in the art can easily change the form of analysis through a slight modification of the flow path and revisions of the Specification after mounting the elements required for immunoassay, for example, on the micro-reactor.

The micro-reactor chip for gene inspection is provided with a sample storage section, a reagent storage section, a probe DNA storage section, a control storage section, a flow path, a pump connecting section, a liquid feed control member, a backflow preventing member, a reagent determining section and a mixing section. They are installed at functionally adequate positions according to the micromachining technology. If further required, a reverse transcriptase part may be arranged. The sample storage section communicates with the sample injection section. It stores samples temperature temporarily and supplies samples to the mixing section. If required, the sample storage section can be assigned with the functions of blood cell separation and adjustment of liquid sample viscosity. Mixing between reagents, and mixing between sample and reagent can be done at a desired rate by a single mixing section. Alternatively, one of them or both can be separated and a plurality of confluence sections can be arranged so that a desired mixing ratio can be obtained in the final phase.

Such a sample as blood is injected into the aforementioned sample storage section of the micro-reactor and the apparatus proper is mounted on the micro-reactor, whereby processing required for gene amplification reaction and detection is carried out automatically in the chip, and gene inspection is conducted simultaneously for a plurality of items in a shorter time. In the preferred arrangement of the micro-reactor for gene inspection according to an embodiment of the present invention, the micro-reactor is filled with a predetermined amount of required reagents in advance. The micro-reactor is used for each sample as a chip for predetermined amplification reaction with the sample DNA and RNA and detection of the amplification product.

In the meantime, the control system to provide control of the liquid feed, temperature and reaction, and the unit in charge of optical detection, data collection and processing, together with the micro-pump and optical apparatus, constitute the biological substance inspection device proper. This device proper can be used for the samples in common when the aforementioned chip is mounted thereon. This arrangement allows quick and efficient processing of a great number of samples. In the conventional art, when analysis or synthesis of different contents is conducted, it has been necessary to configure a micro-fluid device conforming to the contents to be modified. By contract, an embodiment of the present invention requires the replacement of only the replaceable chip. Modification of the control of each device element, if required, can be achieved by changing the control program stored in the apparatus proper.

Any of the components used in the gene inspection device are downsized for easy portability, and is characterized by excellent workability and maneuverability, independently of the place and time of use. Since this device ensures quick measurement independently of the place and time of use, it can be used for emergency medical care, or for private application in the field of home medical care. The apparatus proper incorporates a large number of micro-pump units used to feed the liquid, and others, and therefore, the chip can be used as a disposable unit.

The biological substance inspection micro-reactor and biological substance inspection device have been outlined with reference to gene inspection. The present invention can be embodied in a great number of variations with appropriate modification or additions, without departing from the technological spirit and scope of the invention claimed. To be more specific, all or part of the micro-reactor and inspection apparatus can be formed in a great number of variations, if the structure, arrangement, layout, configuration, dimensions, material, scheme and method do not depart from the technological spirit and scope of the present invention.

Preferred Embodiment of Biological Substance Inspection Micro-reactor

The preferred embodiment of the biological substance inspection micro-reactor is characterized in that one chip contains:

a sample storage section charged with a sample or a biological substance (e.g. DNA) extracted from the sample;

a reagent storage section for storing the reagent used for probe combination reaction and detection reaction (including the gene amplification reaction or antigen-antibody reaction);

a positive control storage section for storing positive control;

a negative control storage section for storing negative control;

a probe storage section for storing a probe (e.g. a probe to be hybridized with the gene to be detected, the gene being amplified by gene amplification reaction)

a flow path communicating with each of the storage sections; and a pump connecting section for connection with a separate micro-pump for feeding a liquid in the storage sections and flow paths;

wherein the biological substance inspection micro-reactor comprising:

connecting a micro-pump to the aforementioned chip through the pump connecting section;

feeding to the flow path, the sample stored in the sample storage section or the biological substance extracted from the sample (e.g. DNA or other biological substances), which is mixed and subjected to reaction at the reaction site of the minute flow path, e.g. the site for gene amplification reaction (antigen-antibody reaction in the case of protein);

feeding thereafter to the detection section located in the flow path downstream, thereof the processed liquid formed by processing this reaction liquid and the probe stored in the probe storage section;

mixing the liquid in the flow path;

combining (or hybridizing) the liquid with the probe; and detecting the biological substance based on this reaction product;

wherein the biological substance inspection micro-reactor applies the same procedure to the positive control stored in the positive control storage section and the negative control stored in the negative control storage section, the aforementioned procedure comprising:

causing the positive control or negative control to react with the reagent stored in the reagent storage section, in the flow path;

combining (or hybridizing in the case of gene analysis) the positive control or negative control with the probe stored in the probe storage section thereafter, in the flow path; and detecting the aforementioned reaction based on this reaction product.

Division of Reagent and Sample

Micro-pump and Pump Connecting Section

In the present embodiment, the sample storage section 20, reagent storage section 18, positive control storage section 21*h* and negative control storage section 21*i* are each provided with a micro-pump 11 for feeding the liquids in these surface tensions. The micro-pump 11 is connected to the upstream side of the reagent storage section 18, and the driving solution is fed to the reagent storage section by the micro-pump 11, whereby the reagent is pushed out into the flow path and is fed. The micro-pump unit is incorporated into an apparatus proper (biological substance inspection device) separate from the micro-reactor. When the micro-reactor is mounted on the apparatus proper, it is connected from the pump connecting section 12 to the micro-reactor.

In the present embodiment, a piezo-pump is used as the micro-pump. This piezo-pump is provided with:

a first flow path wherein the flow path resistance varies in response to differential pressure;

a second flow path wherein percentage of the change in the flow path resistance with respect to that in differential pressure is smaller than that of the first flow path;

a pressure chamber connected to the first and second flow paths; and an actuator for changing the pressure inside the pressure chamber.

The details are disclosed in the aforementioned Official Gazette of Japanese Patent Tokkai 2001-322099 and Official Gazette of Japanese Patent Tokkai 2004-108285.

Liquid Dividing Section

Figure 3:
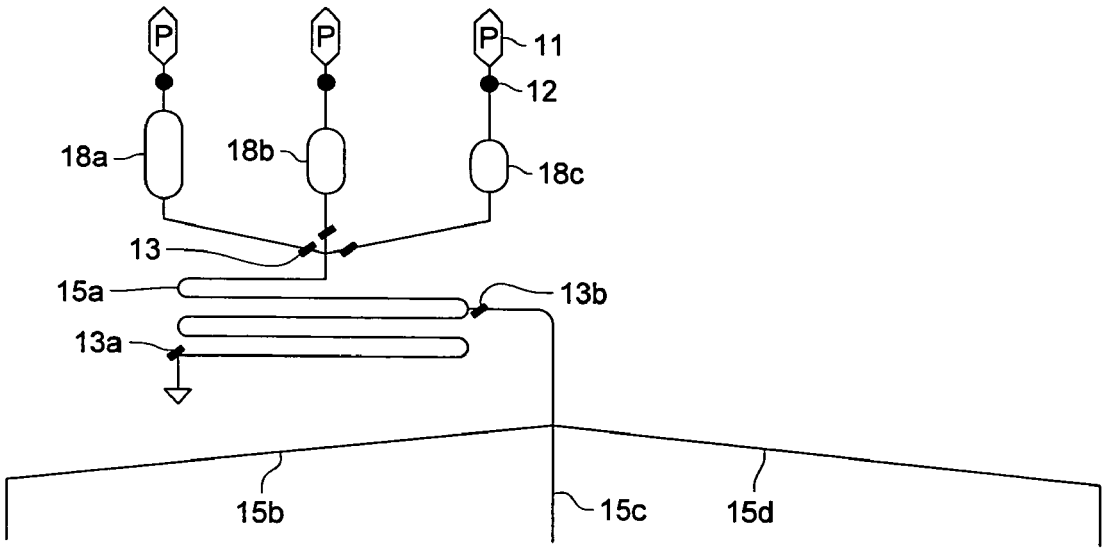
FIG. 3 is a diagram showing the sample mixing section of the micro-reactor as an embodiment of the present invention.

In an embodiment of the present invention, when a plurality of items of one sample are to be analyzed, and when the positive control negative control are analyzed simultaneously, the reagent and sample must be each separated into two or more parts. The liquid dividing section is provided to meet this requirement. To put it more specifically, the liquid dividing section is composed of a branched minute flow path, a liquid feed control member 13 and a backflow preventing member 16, as shown in FIGS. 2 and 3.

The liquid feed control member 13 blocks the passage of the liquid until the liquid feed pressure in the forward direction reaches a predetermined level, and permits the passage of liquid by adding the liquid feed pressure above a preset level. The backflow preventing member 16 is composed of a check valve wherein the valve body closes the flow path opening through backflow pressure, or an active valve wherein the valve body is pressed against the flow path opening through a valve body deformation device, thereby closing the opening.

In the minute flow path, feed of the liquid in the branched flow path, determination of the amount of the liquid to be fed, and mixing of each of the liquids are controlled by the aforementioned micro-pump, the liquid feed control member wherein the passage of liquid can be controlled by the micro-pump, and the backflow preventing member for preventing the liquid in the flow path from flowing in the backward direction. This arrangement allows the reagent and sample to be divided at an adequate proportion by the operation of such a liquid dividing section and micro-pump 11. That is to say, all of the liquid feed control members 13 in each of the branched minute flow paths are on the blocking state under a pressure which is lower than the pressure which makes the flow control sections open, and a predetermined volume of liquid is filled between liquid feed control members 13 and the check valves 16 on each of the minute flow paths. Therefore the liquid dividing section according to an embodiment of the invention can divide liquid into a predetermined volume in each of the blanched minute flow paths.

Further, feeding, determining and mixing of the predetermined volume of divided liquid can be conducted by injecting liquid into the minute flow path from the flow path which is connected to the downstream of the check valve.

Sample Storage Section

Figure 4:
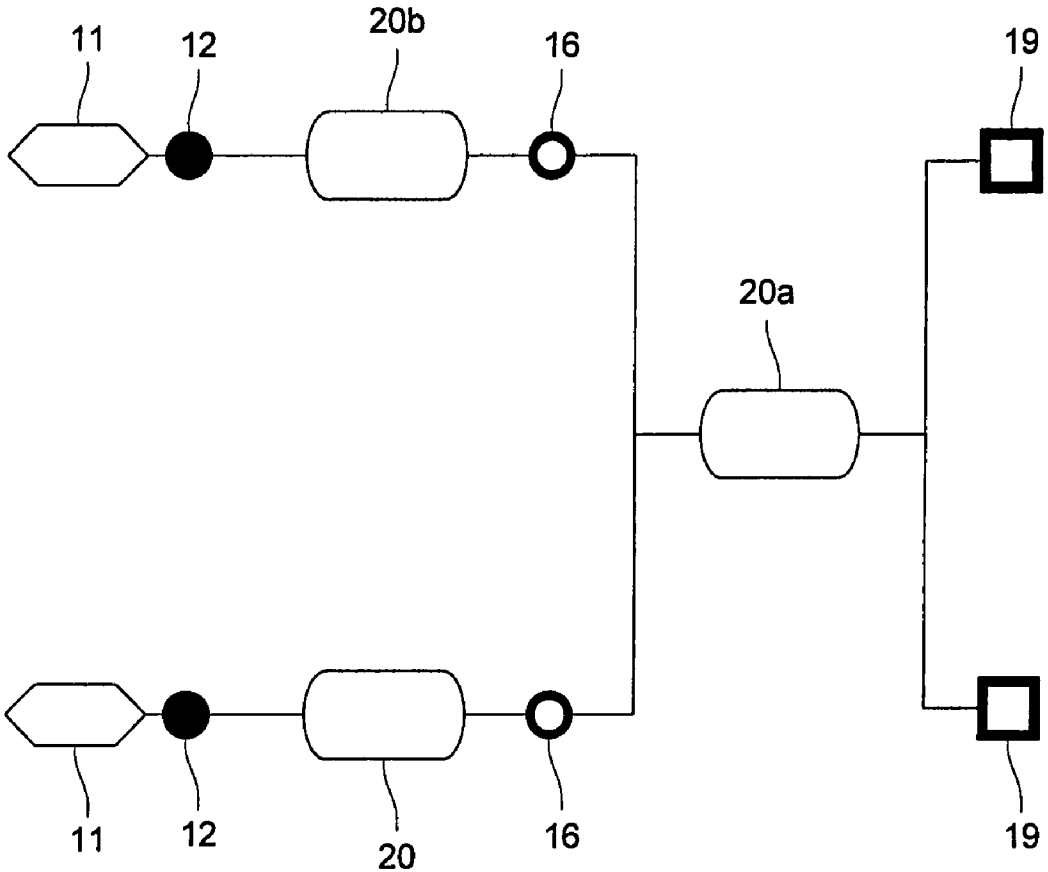
FIG. 4 is a diagram representing a sample storage section 20, sample pre-processing section 20*a* and sample splitting.
Figure 5:
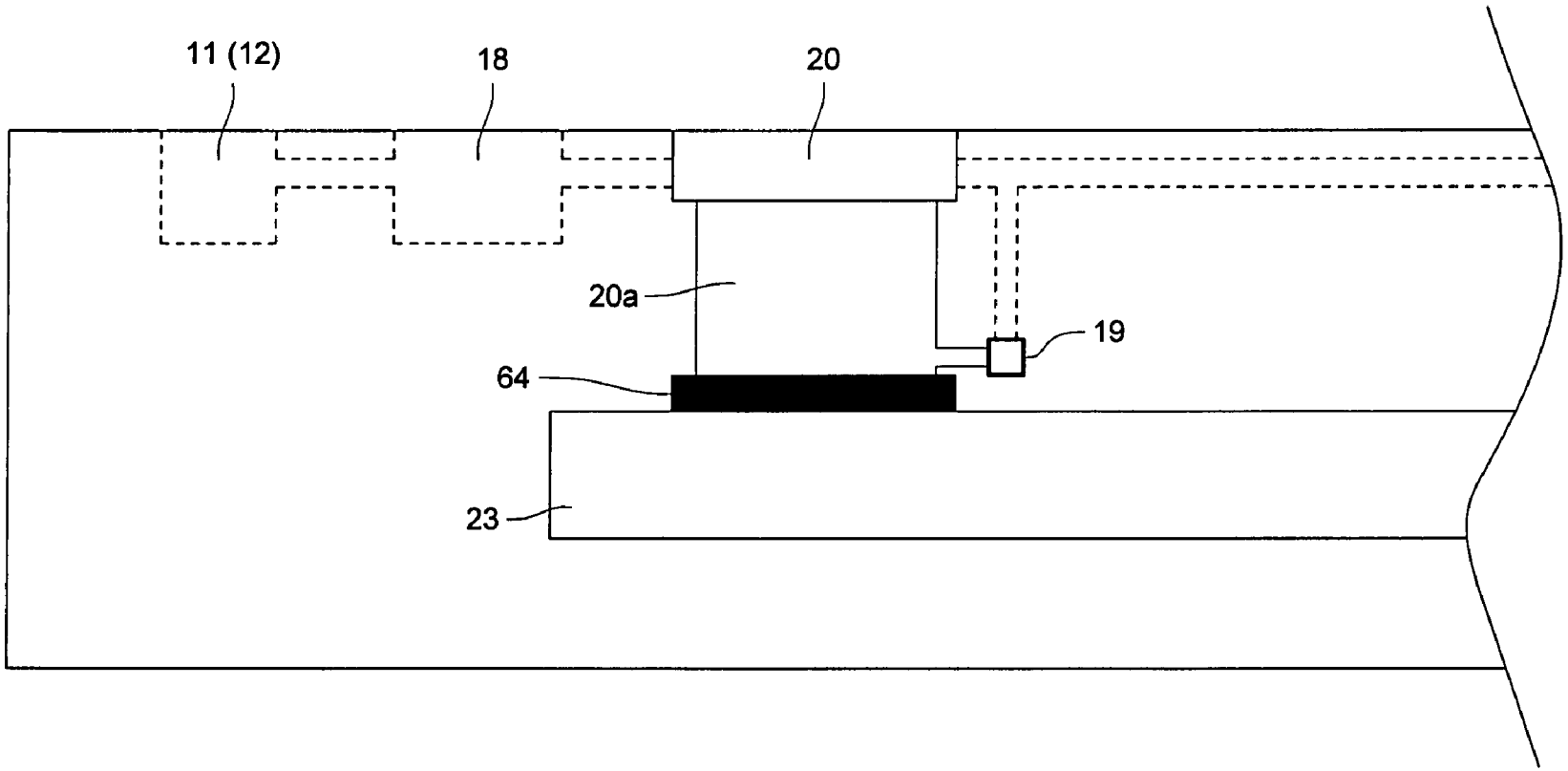
FIG. 5 is a cross sectional view showing part of the micro-reactor, wherein the positional relationship of the confluence between the flow path from the reagent storage section, the sample pre-processing section 20*a* of FIG. 4 and sample port 19 is illustrated, and the elements indicated by dotted line are not located on the same cross sectional position with those indicated by solid lines.

The sample storage section 20 of the micro-reactor is designed in a structure shown in FIGS. 4 and 5. The sample having been injected into the sample storage section 20 is linked with the micro-pump 11 and pump connecting section 12. The liquid is fed to the sample pre-processing section 20*a* by the operations of these components. The sample pre-processing section 20*a* allows the sample to be pre-processed by the processing solution fed from the sample processing solution storage section 20*b*. This sample pre-processing section 20*a* is mounted wherever required. Sample pre-processing is specifically exemplified by separation and concentration of the substance to be analyzed, and deproteinization. Thus, the sample pre-processing section 20*a* may contain a separation filter, adsorption resin and beads.

Figure 6:
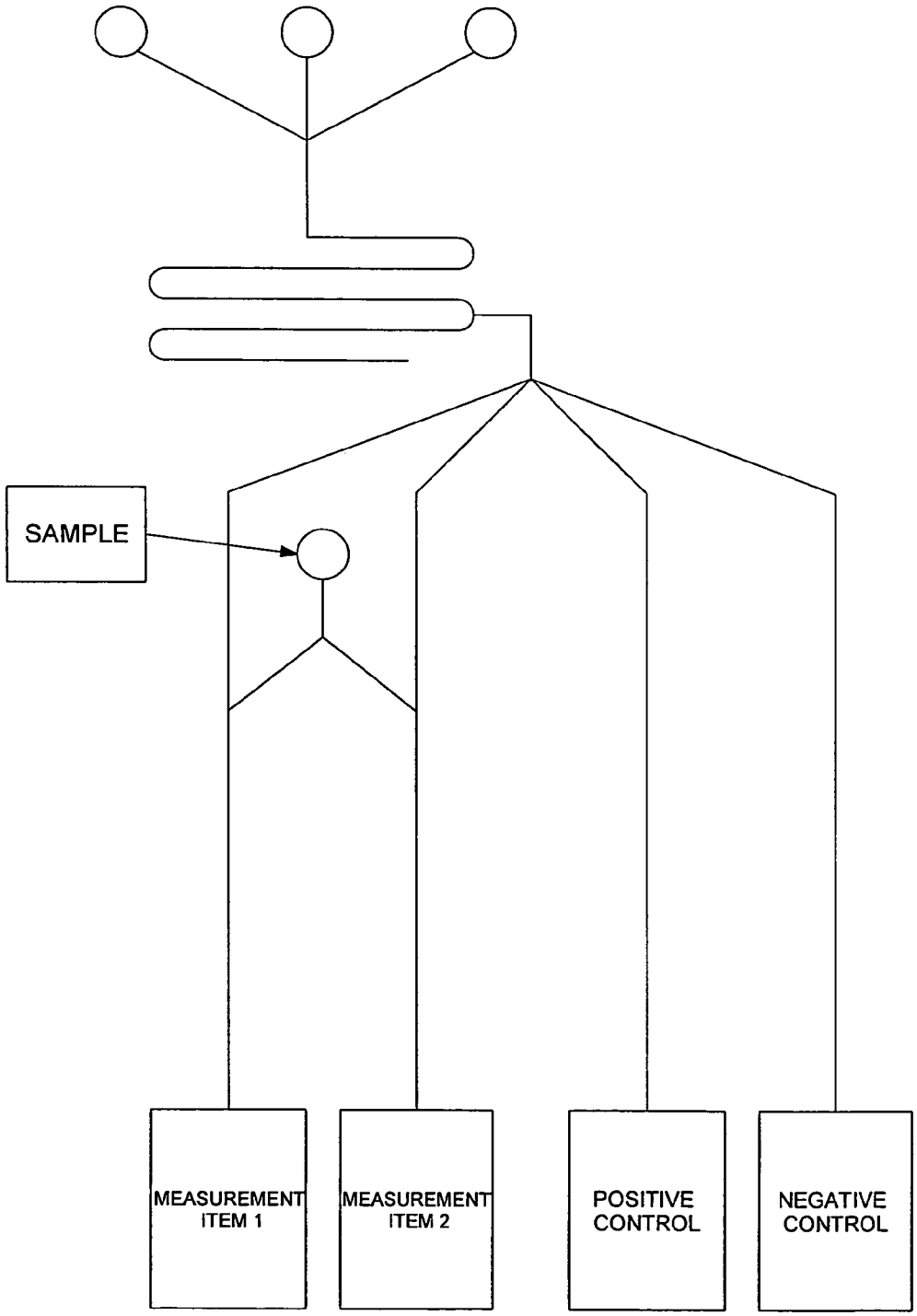
FIG. 6 is a diagram showing an example of the layout of the sample storage section 20 and sample port 19 when there are two items for measurement.

The sample having been pre-processed is divided into two or more minute flow paths for sample analysis by the liquid dividing section, and is sent to the downstream flow path for analysis communicating therewith. From the sample port 19 shown in FIG. 4, the sample having been divided enters the minute flow path through which reagents flow, where the sample merges with liquid. In this case, the liquid being fed is divided so that the sample will be fed to three or more flow paths for analysis. To ensure that the sample merges with the reagents, the port where the sample flows must have a height different from that of the flow path for analysis to be merged. This positional relationship is required for the following reasons:

The elements such as the sample storage section 20 and sample pre-processing section 20*a* shown in FIG. 4 are preferably laid out, downstream of the reagent storage section 18, on the analysis flow path (a minute flow path on the left) for sample analysis as shown in FIG. 2. To be more specific, when one item of the sample is to be measured in FIG. 2, one sample storage section 20 and one sample reservoir 17*b* are sufficient as illustrated. By contrast, when two or more items are to be measured, the sample must be divided in response to the number of the items to be measured, as described above, and must be merged with the liquid in each of the analysis flow paths. To meet this requirement, the aforementioned elements are laid out at adequate positions (not necessarily immediately above) on a plurality of analysis flow paths. The positional relationship is illustrated as examples in FIGS. 5 and 6. When three or more items are to be measured, the sample solution is divided so that the sample is fed to three or more analysis flow paths, and the sample is merged with reagents, then the flow path through which the sample from the sample port 19 flows must cross the flow path through which the reagent flows, in the vertical direction, without merging with these two flow paths, before the sample is merged with reagents. As illustrated, especially when the sample pre-processing section 20*a* is installed, the sample pre-processing section 20*a* is preferably placed at a level lower than the sample storage section 20 so that the unwanted liquid can be discarded. When two items are to be measured and the sample is divided so that the sample solution is fed into two analysis flow paths, sample storage section 20, sample port 19 and others should be installed between these two analysis flow paths, as shown in FIG. 6.

Reaction Site

A sample storage section for storing the aforementioned sample and a reagent storage section for storing reagent solution are arranged along the flow path upstream of the confluence section for merging the solution containing the biological substance to be measured, with the reagent (liquid mixture). At the same time, pump connecting sections are provided upstream of these storage sections. The aforementioned micro-pumps are connected to these pump connecting sections, and the drive solution is supplied from each micro-pump, whereby the sample solution and the reagent inside each storage section are pushed out and are merged. These steps initiate reaction required for the analysis such as gene amplification reaction and antigen-antibody reaction. Such an embodiment of the reaction site is not restricted thereto. The reaction site can be embodied in a great number of variations.

Basically, the reaction site preferably includes:

a confluence section for allowing two or more liquids containing a reaction reagent to be fed and merged by the micro-pump;

a minute flow path, arranged forward of the confluence section, for diffusing and mixing the liquids; and a liquid reservoir arranged forward of the downstream end of the minute flow path and composed of a space wider than the minute flow path, the liquid reservoir storing the liquid mixture diffused and mixed in the flow path so that the liquid mixture is subjected to reaction.

Sample

The sample to be measured is a gene, DNA or RNA as a nucleic acid as a template for amplification reaction, in the case of gene inspection. The sample can be prepared or isolated from the material that may contain such a nucleic acid. There is no particular restriction to the method of preparing a gene, DNA or RNA from such a sample; a conventional method can be used. Further, no restriction is imposed on the sample itself. The sample includes:

almost all samples derived from a living organism such as whole blood, serum, buffy coat, urine, fecal, saliva and sputum;

a cell culture;

a nucleic acid-containing sample such as a virus, bacteria, mildew, yeast, plant and animal;

a sample that may be mixed with or may contain a microorganism and others; and all other samples that may contain other nucleic acid.

A DNA can be separated from a sample and refined by phenol/chloroform extraction and ethanol sedimentation according to the normal method. For the RNA, an adequate reverse transcriptase is used to convert into the cDNA, which is then analyzed. A reverse transcriptase can be easily obtained.

As compared with the method of manual work using the conventional apparatus, the micro-reactor requires only a very small amount of sample. In the case of gene, for example, the required volume of DNA is 0.001 through 100 ng. Accordingly, even when only a trace quantity of sample is available, the micro-reactor imposes a very small restriction on the sample. This naturally leads to a reduced amount of reagent and reduced inspection costs. The sample is injected from the injection portion of the aforementioned "sample storage section".

The conventional art can be used to process the sample including the biological substance other than gene, wherever required.

Gene Amplification Method

There is no restriction to the amplification method of the micro-reactor according to an embodiment of the present invention. For example, the PCR amplification method actively utilized in many fields can be used as the DNA amplification method. The conditions for implementing the amplification method have been studies in details and various documents disclose such conditions, together with proposals for improvements. The PCR amplification requires temperature management to be provided wherein temperature is risen to three temperatures. The present inventors have already disclosed a flow path device capable of temperature control suitable for the microchip (the Official Gazette of Japanese Patent Tokkai 2004-108285). This device system can be applied to the amplification flow path for the chip of the present invention. This allows the thermal cycle to be switched. Since the minute flow path is formed as a micro reaction cell characterized by small thermal capacity, the DNA amplification can be completed in much shorter time, as compared to the case where the conventional method of manual work using the microchip and micro-vial is used.

The recently developed ICAN (Isothermal chimera primer initiated nucleic acid amplification) method that does not require the complicated temperature management as in the PCR reaction allows DNA amplification to be completed in a shorter time at a constant temperature ranging from 50 through 65 degrees Celsius (Patent No. 3433929). Accordingly, the ICAN method provides a preferable amplification method for the micro-reactor because it requires only simple temperature management. In the manual work, one hour is required; whereas, according to the method using the bioreactor, only 10 through 20 minutes, or preferably 15 minutes, are required to complete the work including analysis.

Other improved PCR methods or modified PCR methods can be used for The DNA amplification reaction. The micro-reactor is flexible enough to conform to any of these methods by flow path design changes. When any DNA amplification method is to be used, those skilled in the art can easily introduce that method since the details of the method are disclosed.

Reagents

When the biological substance in the sample is analyzed, the reagents required for measurement are commonly known in most cases. For example, if the antigen in the sample is to be analyzed, the reagent containing the antibody corresponding thereto, preferably monoclonal antibody is utilized. The anti-body is preferably labeled with biotin and FITC. The following describes the reagents required for gene inspection:

(i) Primer

The PCR primer is composed of two types of oligonucleotide complementary to both ends of the DNA chain at a specific site to be amplified. A special-purpose application for this design has already been developed. Those skilled in the art can easily produce the primer using a DNA synthesizer or chemical composition method. The primer used in the ICAN method is a DNA and RNA hybrid primer. The method for preparing them is also already established (Patent No. 3433929). The selection and design of the primer determines the success or failure in amplification reaction, and therefore, the optimum primer must be used.

If the 5'-terminal of the primer is bonded with biotin as a label, the DNA as an amplification product can be immobilized on the substrate through combination with the streptavidin on the substrate for the sake of quantitative determination of the amplification product. Other primer labels include digoxigenin and various types of fluorescent pigments.

(ii) Reagents for Amplification Reaction

Reagents including the enzyme used for amplification reaction for both PCR and ICAN methods can be easily obtained.

The reagents for the PCR method include at least 2'-deoxynucleotide 5'-triphosphate as well as Taq DNA polymerase, Vent DNA polymerase and Pfu DNA polymerase.

The reagents for the ICAN method includes at least 2'-deoxynucleotide 5'-triphosphate as well as a hybrid primer capable of hybridization specific to the gene to be detected, DNA polymerase of chain labilization and RNase of endonuclease.

(iii) Control

Internal control is used in amplification monitoring in the case of a target nucleic acid (DNA and RNA), or as an internal standard substance at the time of quantitative determination. The sequence of the internal control is arranged in such a way that the same primer as that for the sample can be hybridized on both sides of the sequence different from that of the sample. This arrangement allows the control to be amplified in the same way as the sample. The nucleic acid disclosed in the published technological document can be used as the nucleic acid (DNA, RNA) for the control. The negative control includes all the reagents other than nucleic acid (DNA, RNA). It is utilized to check for contamination, and to correct the background.

(iv) Reagent for Reverse Transcription

Reverse transcriptase for synthesizing cDNA from the RNA, and a primer for reverse transcription can be used as a reagent for reverse transcription in the case of RNA sample. They are readily available on the market.

Predetermined amounts of the amplification substrate (2'-deoxynucleotide 5'-triphosphate) and gene amplification reagent are stored in the aforementioned reagent storage section of one micro-reactor in advance. Accordingly, the micro-reactor need not be refilled every time it is used; it is available at any moment.

Detection Site

In the biological substance inspection micro-reactor, a detection site for detecting a biological substance, e.g. amplified gene, is provided downstream of the reaction site of the minute flow path. At least the detecting site of the micro-reactor is transparent or is made of transparent plastics in order to permit optical measurement. Further, the biotinophilic protein adsorbed on the detection site of the minute flow path combines with the biotin labeled with the probe substance, or the biotin containing a label on the 5'-terminal of the primer used for the gene amplification reaction. This arrangement permits the biotin-labeled probe or amplified gene be trapped on the detection site. At least the minute flow path of the detection site is preferably formed of polyethylene.

Visible spectrophotometry, fluorometry and luminescence method are commonly used to detect the DNA of the target gene having been amplified or other biological substance.

Further, electrochemical method, surface plasmon resonance method and crystal oscillation microbalance method are also utilized.

There is no particular restriction on the method of detecting the DNA of the isolated biological substance and amplified target gene. The following basis process is preferably applied, using the aforementioned micro-reactor:

(1a) A sample or DNA extracted from the sample, or a cDNA synthesized by reverse transcription from the sample or DNA extracted from the sample, and a primer modified with biotin at the 5' position are fed to the downstream minute flow path from the storage sections thereof. The gene inside the minute flow path of the reaction site is amplified. Then the amplified solution including the gene amplified in the minute flow path is mixed with the modified solution so that the amplified gene is modified into a chain. The processing solution used for modification of the amplified gene into one chain is fed to the detection site inside the minute flow path with the biotinophilic protein (preferably, streptavidin) adsorbed therein, whereby the amplified gene is trapped. After going these steps, the probe DNA with its terminal fluorescent-labeled with FITC (fluorescein isothiocyanate) is fed to the detection site inside the minute flow path having trapped the amplified gene. The probe DNA is hybridized with the immobilized gene. (The amplified gene hybridized in advance with the fluorescent-labeled probe DNA may be trapped in the detection site).

(1b) The antibody to the antigen present in a sample, preferably the reagent containing the monoclonal antibody, is mixed with the sample. In this case, the sample is labeled with biotin and FITC. Accordingly, the product obtained from antigen-antibody reaction contains biotin and FITC. This is fed to the inspection site inside the minute flow path with the biotinophilic protein (preferably streptavidin) adsorbed therein, and is immobilized on the detection site through the combination between the biotinophilic protein and biotin.

(2) The gold colloid solution whose surface is modified by the anti-FITS antibody that specifically combines with the FITC is fed into the minute flow path. The gold colloid is adsorbed by the FITC of the product, resulting from antigen-antibody reaction, immobilized thereby, or to the FITC modified probe hybridized with the gene.

(3) The concentration of the gold colloid in the aforementioned minute flow path is optically measured.

Biotinophilic protein includes avidin, streptavidin and extra-avidin (R). These forms of avidin each have four avidin binding sites. Streptavidin is preferred to have a higher level of specificity. The present inventors have clarified the suitable conditions for ensuring that this protein derived from streptomyces avidin is adsorbed inside the minute flow path. No special chemical processing is required when the streptavidin is immobilized inside the minute flow path formed on the polystyrene substrate. Namely, only the following steps are sufficient: The biotinophilic protein is dissolved in the SSC buffer solution or physiological saline solution to prepare a solution having a concentration of 10 through 35 μg/mL, preferably, 20 through 30 μg/mL. This is applied onto the minute flow path downstream of the amplification reaction site made of polystyrene; then biotinophilic protein is adsorbed on the flow path. When the streptavidin has been immobilized in the aforementioned manner, the detection site for trapping the amplified gene can be provided very easily. To increase the amount of the streptavidin to be adsorbed, the polystyrene adsorption site may be provided with fine concavo-convex patterns, for example, filaments to increase the surface area of the detection site. The biotinophilic protein adsorbed on the detection site is combined with the biotin labeled with the probe substance or the biotin labeled on the 5'-terminal of the primer used in gene amplification reaction.

The probe is combined with the biological substance. When the protein is measured, the probe corresponds to antibody that binds the FITC as a fluorescent label used for detection, together with the aforementioned biotin. The fluorescent-labeled oligodeoxynucleotide is preferably used as the probe DNA for gene inspection. The sequence complementary with part of the gene base sequence to be detected is selected as a DNA base sequence. Specific combination with the target gene is ensured by adequate selection of the base sequence of the probe DNA, and highly sensitive detection is performed, without being affected by the coexistent DNA and background.

A commonly known fluorescent pigment can be used as a fluorescent pigment for labeling the probe. For example, it contains fluorescent substrates such as common FITC, RITC (rhodamine isothiocyanate), NBD, Cy3 and Cy5. Particularly the FITC is preferred because anti-FITC antibody, for example, gold colloid anti-FITC antimouse IgG can be obtained. Digoxigenin (DIG) of steroid hapten, instead of the fluorescent pigment, may be labeled with the probe DNA. In this case, an anti-DIG-alkali phosphatase labeled antibody is used as an alternative to the FITC antibody.

The fluorescence of a fluorescent pigment FITC can also be measured. In this case, however, photofading and background noise of the fluorescent pigment must also be taken into account. It is preferred to use the method that permits highly sensitive measurement by final visible light.

In the biological substance inspection device, a gold colloid optical detection method based on the gold colloid anti-FITC antimouse IgG is used. Alternatively, the aforementioned probe can be labeled with HRP (horseradish peroxidase), instead of the aforementioned fluorescent pigment. It is also possible to use the reaction of color development is catalyzed by this enzyme. The commonly known color developing substrate for this purpose includes 3,3',5,5'-tetramethylbenzine (TMB), 3,3'-diaminobenzidine (DAB), P-Phenylendiamine (OPD), 5-aminosalicylic acid (5AS), 3-amino-9-ethylcarbazole (AEC), 4-chloro-1-naphthol (4CIN), 4-amino anti-pyrine and o-dianisidine.

Enzyme/color development system such as alkali phosphatase and galactosidase can also be used in addition to peroxidase.

Excellent features of visible absorption spectroscopy as described above are provided by fluorometry, which allows use of general purpose equipment and ensures less disturbing factors and easier data processing. Inspection is preferably carried out using the biological substance inspection device wherein an integrated structure wherein the optical detecting device therefore is incorporated, together with the liquid feed means including the aforementioned micro-pump and the temperature control apparatus for controlling the reaction temperature of each reaction in the flow path of the micro-reactor.

Preferably, a step of feeding the washing solution in the flow path adsorbing the streptavidin, is arranged between the aforementioned steps, wherever required. A preferred washing solution includes various types of buffer solutions, salts solution and organic solvent. In the aforementioned steps, the solution for modification is an reagent for forming gene DNA into one chain, and includes sodium hydroxide and potassium hydroxide, for example.

Control Measurement

In the analysis of a biological substance, negative control is normally added, and analysis is parallel to the analysis of a sample. This is essential for correction of contamination, for example, the color development and fluorescence of the substance mixed in the reagent and others. Further, to increase the reliability of the result of analysis, positive control must also be added. This is of value in detecting the disturbing factor in the reagent to be added, and verifying the adequacy of the set conditions and nonspecific interaction. In the similar manner, addition of internal control is often necessary. This is particularly useful for quantitative analysis.

Simultaneous positive control and internal control are particularly important particularly for gene amplification and antigen-antibody reaction according to the PCR method. This is because it is especially important to check that the PCR reaction and antigen-antibody reaction are carried out properly. For example, when a problem has occurred, this provides the optimum means for verifying if the problem is related to setting conditions, reagents, operation or analysis system. Especially the PCR method allows a trace quantity of gene present in the sample to be amplified hundreds of thousands through several millions times or even more, and therefore, Accordingly, a serious effect will be given by contamination such as cross contamination.

The control effective for determining pseudo-positivity and pseudo-negativity is set according to the conventional method for analysis. In the configuration of the micro-reactor flow path, measurement of control is concurrently carried out in the analysis flow path different from that for the sample, using the same reagent under the same conditions.

In the aforementioned amplification and detection, the order, capacity and timing in feeding the liquid are incorporated, as preset conditions, in the software of the biological substance inspection device in the form of a program. If the biological substance inspection device proper and the micro-reactor removably mounted on this apparatus proper are linked with each other, the flow path of the micro-reactor is activated. Preferably, analysis is automatically started. Reaction of the gene amplification resulting form feeding and mixing the sample and reagent, detection of the reactant and optical measurement are performed automatically in a series of continuous operation steps. Then the measurement data containing required conditions record items is stored into the file.

Inspection by Micro-reactor

Mainly two aspects in gene inspection are provided by the gene amplification method and hybridization method adopted as the detection method in the biological substance inspection device and micro-reactor. A primer having a specific sequence in a certain gene is used as a primer used in the gene amplification reaction, whereby the presence or absence of amplification or amplification efficiency is measured. This makes it possible to determine if the DNA derived from the gene in the sample is the same as the special gene or is different from it. This method is effective especially in quick identification or determination of a virus or bacteria causing an infectious disease. A slight mutation between allelic genes on the homologous chromosome can be detected by the gene specific PCR that utilizes the aller-specific oligonucleotide as a PCR oligomer. This micro-reactor is also compatible with simultaneous measurement of a plurality of items. When a plurality of primers with the base arrangement changed as appropriate is prepared as the primers used in the gene inspection, the present micro-reactor can be used for identification and distinction of mutants in the bacteria and viruses of the same type.

The nucleotide sequence of the probe DNA hybridized with the amplified gene DNA is arranged to be complementary to the target gene, thereby improving the detection accuracy. Alternatively, it is also possible used to detect the gene variation wherein mismatching with synthetic probe in hybridization is used as an index.

Alternatively, gene inspection based on the micro-reactor L determines of a genetic factor exhibiting the susceptibility to a specific disease, and detects genetic variations involving the adverse effect of medicine and variations in the area of regulating gene promoter in addition to coding area. In this case, the primer having a nucleic acid sequence containing a varied portion is used. The aforementioned genetic variation refers to the variation in the nucleotide base of the gene. Analysis of the gene polymorphism using the inspection apparatus helps identify the gene susceptible to disease.

The configuration of the apparatus and the principle of analysis clearly indicate that various gene inspection methods based on the inspection apparatus produce higher precision results in a shorter time with smaller effort using much smaller volume of the sample and simpler apparatus, than the conventional methods of nucleic acid sequence analysis, restriction enzyme analysis and nucleic acid hybridization analysis.

The simultaneous measurement method of a plurality of items by the micro-reactor is applicable to analysis of a plurality of items such as antigen, hormone and metabolic substance for a clinical sample, by adequately designing the probe and detection method to be used, in addition to the aforementioned gene inspection.

The biological substance inspection micro-reactor and biological substance inspection apparatus can be used in the field of gene expression analysis, gene function analysis, single nucleotide polymorphic analysis (SNP), clinical examination/diagnosis, medicine screening, inspection for the safety and toxicity of medicine, agricultural chemical or various other chemicals, environmental analysis, food product inspection, inspection in the field of forensic medicine, chemistry, brewing, fishery, stockbreeding, production of farm products, agriculture, forestry, etc.

Referring to the drawing shown as an example of the preferred embodiment of the present invention, the following further describes the example of the gene inspection, without the present invention being restricted thereto.

The micro-reactor composed on one chip made of resin shown in FIG. 2 automatically performs gene amplification reaction and detection in the chip according to the ICAN method when by injected with the gene sample extracted from the blood or phlegm, whereby simultaneous diagnosis of a plurality of genes is performed. For example, about 2 through 3 μL of blood sample is dropped onto the chip having a length and width of several centimeters. This operation alone allows amplification reaction and detection to be performed when the chip is mounted on the apparatus proper 2 shown in FIG. 1.

The sample injected into the sample storage section 20 and the reagent used for the gene amplification reaction sealed in advance into the reagent storage sections 18*a* through 18*c* of FIG. 2 (including the biotin-modified hybrid primer that specifically hybridizes with the gene as an object of detection, the DNA polymerase of chain labilization, and the endonuclease) are fed to the flow path communicating with each storage section by the micro-pump (not illustrated) incorporated in the apparatus proper of FIG. 1. Then the sample and reagent are mixed in the flow path through the Y-shaped flow path, whereby amplification reaction is conducted. The minute flow path is formed to have a width of 100 μm and a depth of 100 μm, for example. The DNA amplified in this manner is detected by optically measuring the gold colloid at the concentration used for bonding. To put it more specifically, it is detected by the optical detection apparatus (not illustrated) incorporated into the apparatus proper 2 of FIG. 1. For example, light for measurement is applied to the detection site on the analysis flow path for each of the inspection item from the LED or others. The transmitted light or reflected light is detected by an optical detecting device such as an photodiode, CCD camera or photomultiplier tube, whereby the amplified DNA (gene) labeled through the DNA hybridized by this procedure is detected.

In the present embodiment, the micro-reactor has the following structure to ensure that high-precision, high-speed and high-reliability gene inspection is conducted by one chip.

In the first place, all forms of control are integrated into one chip. The internal control, positive control and negative control are sealed into the micro-reactor in advance. The reagent is divided by the operation of the micro-reactor. Concurrently with the sample amplification reaction and detection operation, predetermined steps are taken for amplification reaction and detection of these forms of control. This arrangement allows high-speed and high-reliability gene inspection to be performed.

Secondly, the micro-reactor is provided with:

a liquid feed control member capable of controlling the passage of liquid by the micro-pump pressure, wherein the flow of liquid to each predetermined position of the flow path is blocked until the liquid feed pressure in the forward direction reaches a predetermined level, and the liquid feed pressure above the preset level is then added to allow passage of the liquid; and a backflow preventing member for preventing the liquid in the flow path from back-flowing.

The flow of liquid in the flow path is controlled by the micro-pump, liquid feed control member and backflow preventing member. To be more specific, the reagent and sample are divided during the feed and a fixed amount of the reagent can be fed with high precision. Further, a plurality of reagents fed from the branched flow path can be mixed at a high speed.

The amplification reaction and detection operation using the micro-reactor will be described with reference to the major components of the micro-reactor.

Reagent Storage Section

The micro-reactor 1 is provided with a plurality of reagent storage sections 18, which stores the reagent used for gene amplification reaction, the solution used for modification of the amplified gene and the probe DNA to be hybridized with the amplified gene.

The reagent storage section 18 is preferably loaded with reagent in advance so that the quick inspection can be conducted independently of the place or time. The surface of the reagent storage section is sealed to prevent the reagents incorporated in the chip from being subjected to evaporation, loss by leakage, entry of bubbles, contamination and deterioration. Further, when the micro-reactor is kept in store, it is filled with a sealant to ensure that the reagent will not leak from the reagent storage section into the minute flow path and reaction of the reagent will not occur. When the reagent is stored in the micro-reactor in advance, the micro-reactor is preferably kept in cold storage for the safety of reagent. This sealant is solidified or gelated before use under the cold-storage condition where the micro-reactor is stored. When its temperature is raised to the room temperature immediately before use, the sealant melts and becomes fluid. The reagent is preferably sealed into the reagent storage section by placing sealant between the reagent and flow path 15 communicating with the reagent storage section 18. Air may be present between the sealant and reagent, but the amount of air present is preferred to be sufficiently small (with respect to the amount of reagent) in order to feed a fixed amount of liquid.

A plastic substance that does not easily dissolved in water can be used as the sealant. Use of oils and fats having a solubility of 1% or less is preferred. Similarly, a sealant may be applied between the storage sections for positive control and negative control, and the flow path communicating therewith.

Reagent Determining Section

Quantitative feed of reagent can be performed using the aforementioned liquid feed control member and backflow preventing member. In the reagent determining section, a predetermined amount of reagent is applied in the flow path (reagent-filled flow path 15*b*) between the backflow preventing member 16 and liquid feed control member 13*d*. Further, a branched flow path is provided, which branches off from the reagent-filled flow path 15*b* and communicates with the micro-pump 11 for feed the drive liquid. The variation in quantitative determination will be reduced by installing a large-capacity reservoir 17*a* in the reagent-filled flow path 15*b*.

In the step of reagent mixing, two types of reagent are mixed in a Y-shaped flow path. In this case, the mixing ration in the leading portion of the liquid flow is not stabilized even if simultaneous feeding of reagents is performed. To solve this problem, the liquid mixture is preferably fed to the next step after the mixing ratio has been stabilized, by discarding the leading portion of the liquid flow.

Reaction Site

Such reagents as a biotin modified hybrid primer that hybridizes specifically with the gene as a target for detection, a DNA polymerase of chain labilization, an endonuclease are stored in the reagent storage sections 18*a*, 18*b* and 18*c* in FIG. 3. On the side upstream of each reagent storage section, a piezo-pump 11, incorporated in the apparatus proper, separate from the micro-reactor is connected by the pump connecting section 12. Reagents are fed by these pumps to the flow path 15*a* on the downstream side from each reagent storage section.

The flow path 15*a*, the flow path branched off from the flow path 15*a*, leading to the next step, and the liquid feed control members 13*a* and 13*b* are configured in such a way as to discard the leading portion of the reagent mixture fed from each reagent storage section, and to feed the reagent mixture to the next step after stable mixing has been reached. Each reagent storage section stores a total of more than 7.5 μL of reagent. A total of 7.5 μL of reagent mixture subsequent to the process of discarding the leading portion is fed to the three branched flow paths 15*b*, 15*c* and 15*d*, the amount of reagent fed to each of the flow paths being 2.5 μL. The flow path 15*b* communicates with a reaction/detection system 22 (FIGS. 2 and 3) (reaction with sample); the flow path 15*c* with a reaction/detection system 22 (FIGS. 2 and 3) (reaction with positive control); and the flow path 15*d* with the reaction/detection system 22 (FIGS. 2 and 3) (reaction with negative control).

The reservoir 17*a* of FIG. 2 is filled in with the reagent mixture fed to the flow path 15*b*. A reagent-filled flow path is formed between the backflow preventing member 16 upstream of the reservoir 17*a* and the liquid feed control member 13*d* downstream thereof. It forms the aforementioned reagent determining section, together with the liquid feed control member 13*e* installed on the branched flow path communicating with the piezo-pump 11 for feeding drive liquid.

The sample extracted from the blood and phlegm is injected from the sample storage section 20 in FIG. 2. A fixed amount of sample (2.5 μL) is fed into the reservoir 17*b* using the same mechanism as that of the aforementioned reagent determining section, and is then fed to the succeeding flow path. The sample filling in each of the reservoirs 17 and the reagent mixture are fed to the flow path 15*e* (volume: 5 μL) through the Y-shaped flow path. Mixing and ICAN reaction are carried out in the flow path 15*e*. Here the sample and reagent are fed by the pumps 11 and 11*b*, which are alternately driven to introduce the round slices of sample and reagent mixture alternately into the flow path 15*e*, thereby ensuring quick diffusion and mixing between the simple and reagent.

In the amplification reaction, 5 μL of reaction solution and 1 μL of reaction stop solution stored in the stop solution storage section 21*a* are fed into the flow path 15*f* having a volume of 6 μL, and are mixed together, whereby amplification reaction is stopped. Then 1 μL of the modification solution stored in the modification solution storage section 21*b* and 0.5 μL of the mixture of reaction solution and stop solution are fed to the flow path 15*g* having a volume of 1.5 μL, and are mixed. The amplified gene is modified into one chain. Then 2.5 μL of the hybridization buffer stored in the hybridization buffer storage section 21*c* and 1.5 μL of processing solution having been modified are fed to the flow path 15*h* having a volume of 4 μL, where they are mixed there.

Detection Site

The processing solution is fed to the detection sites 22*a* and 22*b* with streptavidin adsorbed inside the flow path, the amount fed each time being 2 μL. The aforementioned amplified gene is immobilized in this flow path. The washing solution stored in each of the storage sections 21*d*, 21*f* and 21*e*, the probe DNA solution with the terminal fluorescent-labeled with the FITC, and gold colloid labeled with the anti-FITS antibody are fed by the single pump 11 into the flow path 22*a* where this amplified gene is immobilized, in the order illustrated in FIG. 2. At the same time, the washing solution stored in each of the storage sections 21*d*, 21*g* and 21*e*, the probe DNA solution for internal control, and gold colloid labeled with the anti-FITS antibody are fed by the single pump 11 into the flow path 22*b* where the amplified gene is immobilized, in the order illustrated in the same figure. Then the probe DNA is immobilized with the amplified gene of one chain having been immobilized. A required washing solution is loaded into the washing solution storage section 21*d*, as appropriate.

When the gold colloid solution is fed, gold colloid is bonded with the immobilized amplified gene through the FITC of the probe DNA, and is immobilized in position. The presence or absence of amplification or amplification efficiency is identified by optical detection of the immobilized gold colloid.

The flow paths 15*c* and 15*d* communicates with the positive control reaction/detection system and negative control reaction/detection system. Similarly to the case of the aforementioned sample reaction/detection system, the reagent mixture is fed to these paths, and amplification reaction is conducted with the sample in the flow path. After that, the reagent mixture is hybridized with the probe DNA stored in the probe DNA storage section. Then the amplification reaction is detected based on the reaction product.

EMBODIMENT

The following describes the present invention in greater details with reference to the embodiment. It should be noted, however, that the present invention is not restricted thereto.

Reagents Used

Streptavidin: by Nacalaytesque Inc.

Biotin-introduced gold colloid: Albumin-biotin gold labeled, 20 nm (by Sigma Inc., Product No. A4417)

This was subjected to 50-fold dilution using the following 5×SSC:

Buffer solution (Infiltrated with a 0.2 μm filter for sterilization after preparation)

5×SSC: 750 mM sodium chloride and 75 mM trisodium citrate

Physiological saline solution: 0.9% sodium chloride 50 mM tris-HCl; Tris refers to 2-amino-2-hydroxymethyl-1,3-propandiol.

Pure Water

Detection

A light emitting diode having a maximum wavelength of 520 through 530 nm was placed opposite to a photodiode, and the portion of the sample to be measured was placed between them to measure the photodiode output. To be more specific, the adsorption intensity can be expressed by the following equation:

$$\log (I_0/I_0+(I_g-I_b))$$

where "$I_0$" denotes the numerical value when there was nothing between the light emitting diode and photodiode, "$I_b$" the numerical value on a non absorption basis, and "$I_g$" the numerical value when the gold colloid is reacted.

Procedure

A silicone rubber with holes each having a diameter of 4 mm was bonded on a polystyrene sheet. These holes each were filled with 12 μL of streptavidin solutions having various concentrations (9 concentrations ranging from 10 through 50 μg/mL), prepared using various types of buffer solutions (Tris buffer, SSC buffer, hybrid buffer, and physiological saline solution). Silicone rubber covers were placed over the holes of silicone rubber to block them. They were left to stand for an hour at the room temperature. The streptavidin solution was removed and the holes are washed three times by various types of buffer solution. Then 2 μL of biotin-labeled gold colloid was put into the silicone holes. The biotin-labeled gold colloid was removed and the holes are washed three times by various types of buffer solution. The silicone rubber was removed and the polystyrene sheet was dried.

After that, the optical concentration on the hole portion of the polystyrene sheet and other portions was measured and the adsorption intensity of the gold colloid was calculated according to the aforementioned expression. Table 1 shows the result obtained by this procedure. It has been revealed that the optimum streptavidin concentration is 25 μg/mL. The buffer solutions to be used include physiological saline solution, SSC Tris and pure water in that order of preference.

TABLE 1

| Streptavidin concentration (μg/mL) | Streptavidin adsorption intensity | | | |
|---|---|---|---|---|
| | Tris | Pure water | 5 × SSC | Physiological saline solution |
| 10 | 0.0006 | 0.0006 | 0.0033 | 0.0034 |
| 15 | 0.0009 | 0.0009 | 0.0034 | 0.0176 |
| 20 | 0.0005 | 0.0005 | 0.0139 | 0.0275 |
| 25 | 0.0009 | 0.0009 | 0.0261 | 0.0517 |
| 30 | 0.0013 | 0.0003 | 0.0191 | 0.0157 |
| 35 | 0.0084 | 0.0024 | 0.0183 | 0.0097 |
| 40 | 0.0021 | 0.0021 | 0.0145 | 0.0102 |
| 45 | 0.0015 | 0.0015 | 0.0125 | 0.0048 |
| 50 | 0.0008 | 0.0008 | 0.0127 | 0.0096 |

While the preferred embodiments of the present invention have been described using specific terms, such description is for illustrative purposes only, and it is to be understood that changes and variations may be made without departing from the spirit or scope of the appended claims.

What is claimed is:

1. A micro-reactor for biological substance inspection comprising:

a liquid dividing section which has a plurality of first minute flow paths branched off from a second minute flow path which feeds liquid;

a backflow preventing member which is provided on each of the plurality of the first minute flow paths and prevents backflow of the liquid flowing in the plurality of the first minute flow paths; and a liquid feed control member which inhibits liquid from passing through when a pressure of the liquid is less than a predetermined value, and allows the liquid to pass through when the pressure of the liquid is not less than the predetermined value;

wherein the liquid fed from the second minute flow path stops at the liquid feed control member, then a predetermined volume of the liquid defined by a volume between the liquid feed control members and the backflow preventing members is divided in the plurality of the first minute flow paths.

2. A micro-reactor for biological substance inspection according to claim 1, comprising:

a flow path, which has a liquid feed control member and a backflow preventing member, is connected to the downstream of the backflow preventing member of the plurality of the first minute flow paths and feeds liquid to one of the plurality of the first minute flow paths;

wherein determination and/or mixing is conducted in the plurality of the first minute flow paths by feeding liquid into the first minute flow path from the flow path.

3. A micro-reactor for biological substance inspection according to claim 1, comprising:

a sample storage section which stores a sample;

a sample pre-processing section which is provided downstream of the sample storage section and pre-processes a sample fed from the sample storage section to generate a pre-processed sample, wherein the liquid dividing section is provided downstream of the sample pre-processing section;

a plurality of reagent storage sections which are provided downstream of the liquid dividing section;

a plurality of reaction sites which are provided downstream of the liquid dividing section and in which the reaction of the pre-processed sample and a reagents fed from the plurality of the reagent storage section occurs; and a plurality of detection sites which are provided downstream of the reaction sites and in which detection of biological substance is conducted, wherein screening of a plurality of items is conducted simultaneously.

4. A micro-reactor for biological substance inspection according to claim 1, comprising:

a reagent storage section which stores a reagent, wherein the liquid dividing section is provided downstream of the reagent storage section;

a sample storage section which stores a sample and is connected to the downstream of the liquid dividing section;

a control storage section which stores a control and is connected to the downstream of the liquid dividing section;

a plurality of reaction sites which are provided downstream of the liquid dividing section and wherein the reactions of a mixture of a sample fed from the sample storage section and the reagent and a mixture of a control fed from the control storage section and the reagent occur; and a plurality of detection sites which are provided downstream of the reaction sites and in which detection of biological substance is conducted, wherein screenings of the sample and the control are conducted simultaneously.

5. A micro-reactor for biological substance inspection according to claim 3, comprising a micro-pump connection member to which a piezo-pump is connected, wherein the piezo-pump includes:

a first flow path whose resistance changes in response to pressure difference;

a second flow path in which the change ratio of the flow path resistance in response to the change in pressure is smaller than the change ratio of the flow path resistance of the first flow path;

a pressure chamber which is connected to the first flow path and the second flow path; and a piezo actuator for changing the internal pressure of the pressure chamber, wherein feeding of liquid is conducted by the piezo-pump.

6. A micro-reactor for biological substance inspection according to claim 3, wherein at least the detection site is made of polystyrene.

7. A micro-reactor for biological substance inspection according to claim 3, wherein a biotinophilic protein which combines with biotin labeled to a biotin-labeled probe or combines with biotin labeled to a 5'-terminal of a primer used for gene amplification is absorbed in the detection site.

8. A micro-reactor for biological substance inspection according to claim 7, wherein the biotinophilic protein is streptavidin.

9. A biological substance inspection device comprising:

a micro-reactor for biological substance inspection; and a detecting device which detects biological substance by optically detecting color development of a biotin-labeled probe combined with a biotinophilic protein;

the micro-reactor including:

a liquid dividing section which has a plurality of first minute flow paths branched off from a second minute flow path which feeds liquid;

a backflow preventing member which is provided on each of the plurality of the first minute flow paths and prevents backflow of the liquid flowing in the plurality of the first minute flow paths;

a liquid feed control member which inhibits liquid from passing through when a pressure of the liquid is less than a predetermined value, and allows the liquid to pass through when the pressure of the liquid is not less than the predetermined value;

a sample storage section which stores a sample;

a sample pre-processing section which is provided downstream of the sample storage section and pre-processes a sample fed from the sample storage section to generate a pre-processed sample, wherein the liquid dividing section is provided downstream of the sample pre-processing section;

a plurality of reagent storage sections which are provided downstream of the liquid dividing section;

a plurality of reaction sites which are provided downstream of the liquid dividing section and in which the reaction of the pre-processed sample and reagents fed from the plurality of the reagent storage section occurs; and a plurality of detection sites which are provided downstream of the reaction sites and in which detection of biological substance is conducted;

wherein the liquid fed from the second minute flow path stops at the liquid feed control member, then a predetermined volume of the liquid defined by a volume between the liquid feed control members and the backflow preventing members is divided in the plurality of the first minute flow paths, screening of a plurality of items is conducted simultaneously, and the biotinophilic protein which combines with biotin labeled to the biotin-labeled probe or combines with biotin labeled to a 5'-terminal of a primer used for gene amplification is absorbed in the detection site.

10. A biological substance inspection device according to claim 9, comprising:

a device body which has the detecting device, a micro-pump which is connected to the micro-pump connecting member and feeds liquid and temperature control device which controls the temperature of the micro-reactor;

the micro-reactor for biological substance inspection which is detachable to the device body; and a control section which controls the micro-pump, the temperature control device and the detecting device to detect the probe automatically.

11. A micro-reactor for biological substance inspection according to claim 4, comprising a micro-pump connection member to which a piezo-pump is connected, wherein the piezo-pump includes:

a first flow path whose resistance changes in response to pressure difference;

a second flow path in which the change ratio of the flow path resistance in response to the change in pressure is smaller than the change ratio of the flow path resistance of the first flow path;

a pressure chamber which is connected to the first flow path and the second flow path; and a piezo actuator for changing the internal pressure of the pressure chamber, wherein feeding of liquid is conducted by the piezo-pump.

12. A micro-reactor for biological substance inspection according to claim 4, wherein at least the detection site is made of polystyrene.

13. A micro-reactor for biological substance inspection according to claim 4, wherein biotinophilic protein which combines with biotin labeled to biotin-labeled probe or combines with biotin labeled to a 5'-terminal of a primer used for gene amplification is absorbed in the detection site.

14. A micro-reactor for biological substance inspection according to claim 8, wherein the biotinophilic protein is streptavidin.

15. A biological substance inspection device comprising:

a micro-reactor for biological substance inspection; and a detecting device which detects biological substance by optically detecting color development of biotin-labeled probe combined with biotinophilic protein;

the micro-reactor including:

a liquid dividing section which has a plurality of first minute flow paths branched off from a second minute flow path which feeds liquid;

a backflow preventing member which is provided on each of the plurality of the first minute flow paths and prevents backflow of the liquid flowing in the plurality of the first minute flow paths;

a liquid feed control member which inhibits liquid from passing through when a pressure of the liquid is less than a predetermined value, and allows the liquid to pass through when the pressure of the liquid is not less than the predetermined value;

a reagent storage section which stores a reagent, wherein the liquid dividing section is provided downstream of the reagent storage section;

a sample storage section which stores a sample and is connected to the downstream of the liquid dividing section;

a control storage section which stores a control and is connected to the downstream of the liquid dividing section;

a plurality of reaction sites which are provided downstream of the liquid dividing section and wherein the reactions of a mixture of a sample fed from the sample storage section and the reagent and a mixture of a control fed from the control storage section and the reagent occur; and a plurality of detection sites which are provided downstream of the reaction sites and in which detection of biological substance is conducted;

wherein the liquid fed from the second minute flow path stops at the liquid feed control member, then a predetermined volume of the liquid defined by a volume between the liquid feed control members and the backflow preventing members is divided in the plurality of the first minute flow paths, screenings of the sample and the control are conducted simultaneously, and the biotinophilic protein which combines with biotin labeled to the biotin-labeled probe or combines with biotin labeled to a 5'-terminal of a primer used for gene amplification is absorbed in the detection site.

* * * * *